US006318465B1

(12) United States Patent
Coon et al.

(10) Patent No.: US 6,318,465 B1
(45) Date of Patent: Nov. 20, 2001

(54) UNCONSOLIDATED ZONAL ISOLATION AND CONTROL

(75) Inventors: Robert Coon, Houston; Michael Naquin, Kingwood; William Triplett, Spring, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/411,686

(22) Filed: Oct. 4, 1999

Related U.S. Application Data

(60) Provisional application No. 60/107,266, filed on Nov. 3, 1998.

(51) Int. Cl.[7] ..... E21B 43/04

(52) U.S. Cl. ..... 166/278; 166/236; 166/334.4; 166/276

(58) Field of Search ..... 166/276, 278, 166/51, 228, 234–236, 332.1, 332.4, 334.1, 334.4

(56) References Cited

U.S. PATENT DOCUMENTS

| | | | | |
|---|---|---|---|---|
| 4,105,069 | | 8/1978 | Baker | 166/51 |
| 4,273,190 | | 6/1981 | Baker et al. | 166/278 |
| 4,401,158 | | 8/1983 | Spencer et al. | 166/51 |
| 5,211,234 | | 5/1993 | Floyd | 166/276 |
| 5,375,661 | | 12/1994 | Daneshy et al. | 166/278 |
| 5,392,850 | * | 2/1995 | Cornette et al. | 166/51 |
| 5,641,023 | * | 6/1997 | Ross et al. | 166/386 |
| 5,865,251 | | 2/1999 | Rebardi et al. | 166/278 |
| 5,921,318 | * | 7/1999 | Ross | 166/250.17 |

FOREIGN PATENT DOCUMENTS 2 265 399 A 9/1993 (GB) .

* cited by examiner

*Primary Examiner*—David Bagnell
*Assistant Examiner*—Zakiya Walker
(74) *Attorney, Agent, or Firm*—Cantor Colburn LLP

(57) ABSTRACT

A system for enhancing oil production and reducing contamination thereof by such things as water breakthrough in unconsolidated horizontal wells comprises gravel packing, zonal isolation and selective flow control in combination. The significant control provided by the system enables the well operator to create a uniform pressure drop form heel to toe of the horizontal well and avoid commonly experienced water coning and early breakthrough at the heel of the horizontal borehole.

14 Claims, 3 Drawing Sheets

UNCONSOLIDATED ZONAL ISOLATION AND CONTROL

CROSS-REFERENCE TO RELATED APPLICATIONS

This application claims the benefit of U.S. Provisional Application Serial No. 60/107,266 filed Nov. 3, 1998.

BACKGROUND OF THE INVENTION

1. Field of the Invention

The invention relates to the oil field industry. More particularly, the invention relates to hydrocarbon production systems in horizontal wellbores.

2. Prior Art

Horizontally disposed wellbores i.e, wellbores having deviation angles exceeding ±70 have been employed in growing numbers in recent years to access oil reservoirs not previously realistically producible. Where the formation is consolidated, relatively little is different from a vertical wellbore. Where the formation is unconsolidated however, and especially where there is water closely below the oil layer or gas closely above, horizontal wells are much more difficult to produce.

Pressure drop produced at the surface to pull oil out of the formation is at its highest at the heel of the horizontal well. In an unconsolidated well, this causes water coning and early breakthrough at the heel of the horizontal well. Such a breakthrough is a serious impediment to hydrocarbon recovery because once water has broken through at the heel, all production from the horizontal is contaminated in prior art systems. Contaminated oil is either forsaken or separated at the surface. Although separation methods and apparatuses have become very effective they still add expense to the production operation. Contamination always was and still remains undesirable. Zonal isolation has been attempted using external casing packers and open hole packers in conjunction with gravel packing techniques but the isolation of individual zones was not complete using this method and the difficulties inherent in horizontal unconsolidated formation wells have persisted.

Another inherent drawback to unconsolidated horizontal wells is that if there is no mechanism to filter the sand prior to being swept up the production tubing, a large amount of sand is conveyed through the production equipment effectively sand blasting and damaging the same. A consequent problem is that the borehole will continue to become larger as sand is pumped out. Cave-ins are common and over time the sand immediately surrounding the production tubing will plug off and necessitate some kind of remediation. This generally occurs before the well has been significantly depleted.

To overcome this latter problem the art has known to gravel pack the horizontal unconsolidated wells to filter out the sand and support the bore hole. As will be recognized by one of skill in the art, a gravel packing operation generally comprises running a screen in the hole and then pumping gravel therearound in known ways. While the gravel effectively alleviates the latter identified drawbacks, water coning and breakthrough are not alleviated and the horizontal well may still be effectively occluded by a water breakthrough.

Since prior attempts at enhancing productivity in horizontal wellbores have not been entirely successful, the art is still in need of a system capable of reliably and substantially controlling, monitoring and enhancing production from unconsolidated horizontal wellbores.

SUMMARY OF THE INVENTION

The above-identified drawbacks of the prior art are overcome or alleviated by the unconsolidated horizontal zonal isolation and control system of the invention.

The invention teaches a zonally isolated horizontal unconsolidated wellbore where packers are not employed on the outside of the basepipe but a reliable zonal isolation is still created. Zones are created by interspersing blank basepipe with slotted or otherwise "holed" basepipe. The blank pipe is not completely blank but rather includes closeable ports therein at preselected intervals. Screens are employed over these ports and (as conventional) over the slotted basepipe. Upon gravel packing, a near 100% of pack is achieved over the blank pipe section because of the closeable ports. Only about 60% is achievable without the ports. With a full gravel pack of a preselected distance, i.e., the distance of the blank pipe, and the ports closed, isolation is assured with fluid produced for a bad zone being virtually completely prevented from migrating to the next zone. By shutting off production from the undesirable zone, then, through production string seals, only the desired fluid is produced.

DETAILED DESCRIPTION OF THE PREFERRED EMBODIMENTS

Figure 1:
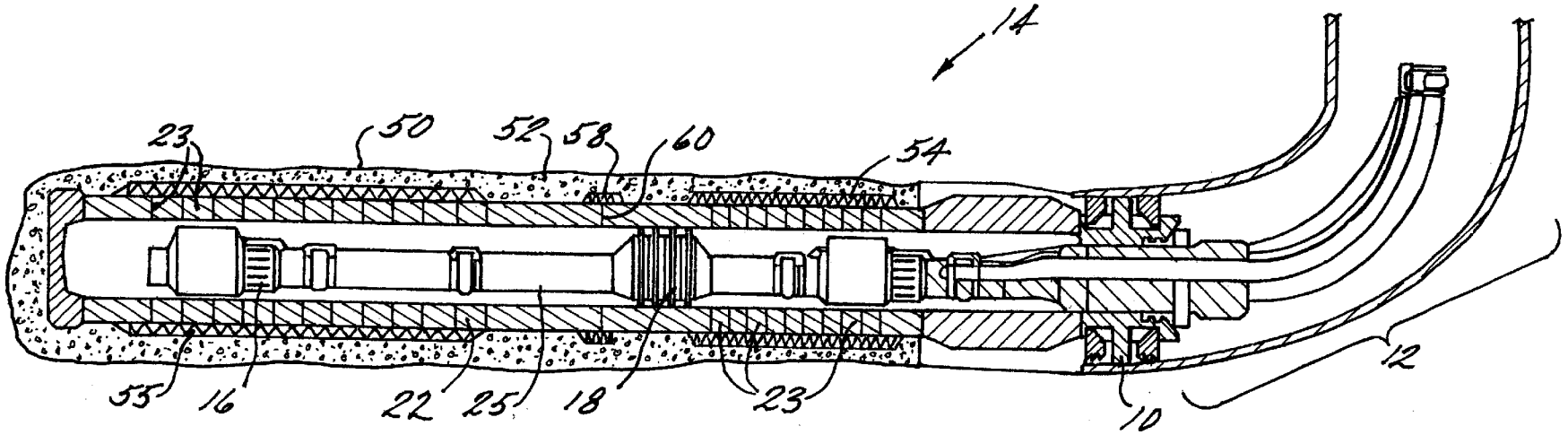
FIG. 1 is a schematic cross section view of an unconsolidated zonal isolation and control system of the invention.
Figure 1A:
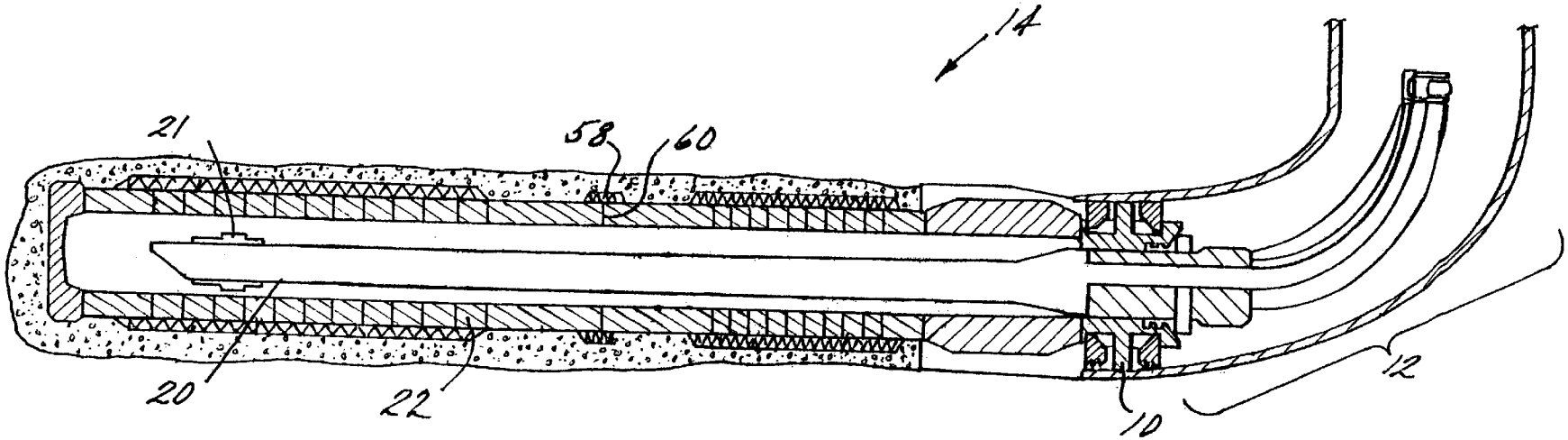
FIG. 1A is a schematic cross section as in FIG. 1, illustrating the washpipe.

In order to most effectively produce from a hydrocarbon reservoir where a horizontal wellbore in an unconsolidated formation is indicated, a gravel pack is ideally constructed. Moreover, the gravel packed area is most desirably zonally isolatable for reasons discussed above. Such zonal isolation preferably is effected by creating unfavorable flow conditions in the gravel pack at selected areas. To complete the system, a number of alternatives are possible: a production string including flow control devices may be run into the hole, each zone being isolated by a locator and a seal; production may commence directly from the base pipe and bridge plugs may be added later to seal certain offending zones; or a straddle packer which extends from blank pipe to blank pipe may be installed on an offending zone. The latter two alternatives are installed conventionally. The various components of the system are illustrated in FIGS. 1 and 1A wherein those of skill in the art will recognize a liner hanger or sand control packer 10 near heel 12 of horizontal wellbore 14. From liner hanger or packer 10 hangs a production string including flow control device 16 which may be hydraulic, mechanical, electrical, electromechanical, electromagnetic, etc. operated devices such as sliding sleeves and seal assemblies 18. Seal assembly 18 operates to create selectively controllable zones within the base pipe of a horizontal wellbore 14. Seal assemblies 18 (in most cases there will be more than one though only one is depicted in FIG. 1) preferably seal against a polished bore in the original gravel packing basepipe 22 which remains in the hole from the previous gravel packing operation. Although the seal assemblies on the inside of the basepipe are effective and controllable, the gravel pack is generally a source of leakage zone to zone as hereinbefore noted. Not visible in FIG. 1 but shown in FIG. 1A for clarity is washpipe 20 which is conventional and known to the art for many years. Additionally, a shifting profile 21 is illustrated in FIG. 1A depending from washpipe 20. The shifting profile may be of any conventional or unconventional type. Shifting profiles in general are known in the art. Still referring to FIGS. 1 and 1A, one of skill in the art will recognize conventional holes 23 in the base pipe and production string 25.

Figure 2:
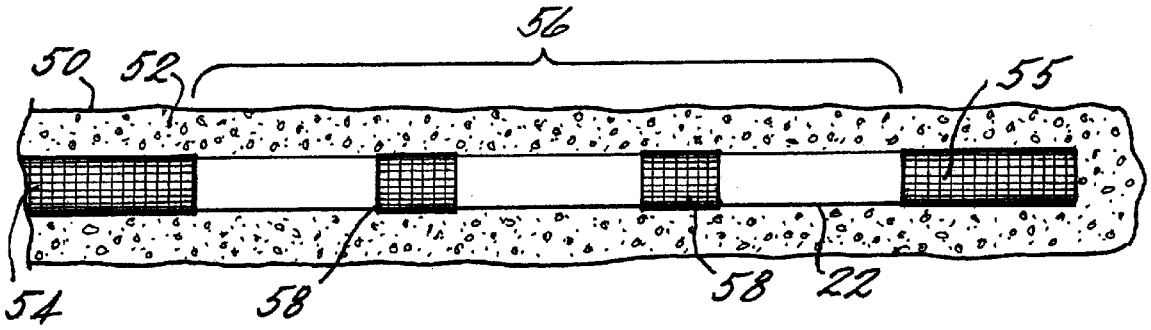
FIG. 2 is a schematic cross section view of a horizontal gravel packed zonal isolation system with dehydration ports in a blank pipe section.

In a preferred zonal isolation embodiment of the invention, referring to FIG. 2, one will recognize the open hole wall 50 and the gravel pack 52. Centered within the packed gravel 52 are several sections of attached pipe. On the left and right sides of the drawing are standard gravel pack zones 54 and 55 which include a slotted or otherwise "holed" base pipe with screen thereover. Between these zones 54 is an elongated section of essentially blank pipe 56. The blank pipe does, however, have what is referred to herein as a dehydration zone which comprises short sections of screen 58 over at least one, preferably several, closeable port(s). The ports enable full packing of gravel around the blank pipe 56. Without the dehydration ports, only about 60% of the annular region surrounding a blank pipe will be packed. Since this provides a 40% open annulus, zonal isolation would be impossible. With a full pack (about 100%), very good zonal isolation is achieved. The isolation between zones is created by the length of blank pipe. Whatever that length be, undesired fluid would have to travel through the gravel pack in the annulus in order to get to a producing zone once the production pipe has shut off the offending zone. For example, if water had been produced from zone 55 but not from zone 54 the answer would be to shut off zone 55 from production in some conventional way and continue to produce from zone 54. Although it is possible to move fluids from zone 55 to zone 54 through the pack 52, it requires a tremendous pressure differential to move any significant volume of fluid. Tests have indicated that at 1500 psi of differential pressure and 40 feet of gravel packed annulus, only 0.6 barrels of the unwanted fluid will migrate to the producing zone through the gravel pack per day. Since in reality it is unlikely that more than 200–300 psi of differential pressure could exist between the zones, the leakage is so small as to be negligible.

As stated above, gravel packing blank pipe is generally an unsuccessful venture. This is because there is no leak-off of the gravel carrier fluid. When there is no leak-off, the velocity of the fluid stays high and the gravel is carried along rather than deposited. Thus, with respect at least to the P wave of the gravel packing operation, very little sand or gravel is deposited in the annulus of the blank pipe. To slow the gravel carrier fluid down, leak-off must occur. With slower fluid, gravel deposition occurs and the desired result is obtained.

Figure 3:
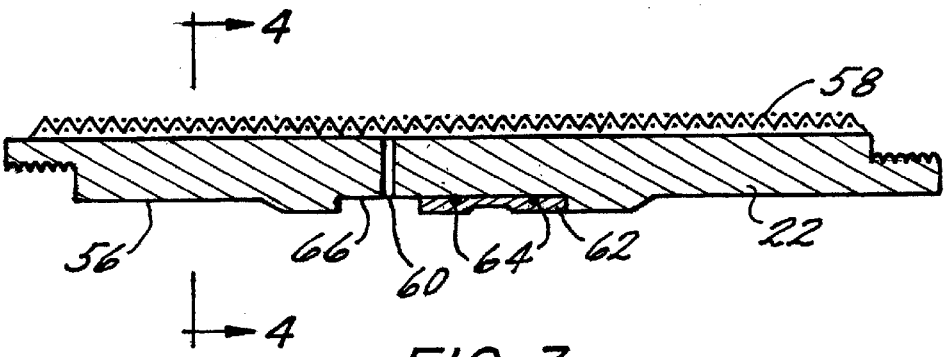
FIG. 3 is an enlarged schematic cross section view of a dehydration section from the invention of FIG. 2.
Figure 4:
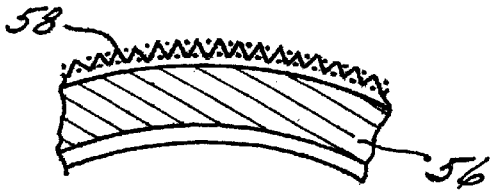
FIG. 4 is a cross section view of FIG. 3 taken along section line 4—4.

The purpose of the blank pipe is zonal isolation. If there can be leak-off in the blank pipe, the zones will be not be isolated. The inventor of the present invention solved the problem by supplying the temporary leak-off paths introduced above as dehydration zones. Referring to FIG. 3, one of the dehydration zones is illustrated in an enlarged format to provide an understanding thereof to one of ordinary skill in the art. The screen 58 is an ordinary gravel pack screen employed as they are conventionally i.e. wrapped around a length of pipe to screen out particles. Under the screen is the essentially blank pipe 56 but which includes one of preferably several ports 60 which operate identically to a selected base pipe in a conventional gravel pack assembly while the ports 60 are open. Ports 60 allow for leak-off and therefore cause gravel to deposit.

When the gravel packing operation is complete and the otherwise conventional washpipe is withdrawn, a profile on the end thereof (not shown but any type of shifting profile is acceptable) is pulled past closing sleeve 62 to close the same. The sleeve 62 completely shuts off port 60 with the sleeve and it seals 64 and is not permitted to open again because of any number of conventional locking mechanisms such as dogs, collet, lock ring, etc. existing preferably at 66. The locking arrangement is needed only to prevent accidental opening of the closing sleeve 62 after it has been closed. Once the closing sleeve 62 is closed, the pipe 56 is indeed completely blank pipe and is a zonal isolator.

Preferably the screen 58 is about one foot in length. Ports 60 may be distributed in many different patterns thereunder with as many ports as desired. One preferred embodiment employs four one quarter inch holes radially arranged about the circumference of the pipe. With respect to the blank pipe section length between the dehydration zones, a range of about five feet to about ten feet is preferred.

Since the provision of different zones and flow control devices in the invention allow the metering of the pressure drop in the individual zones, the operator can control the zones to both uniformly distribute the pressure drop available to avoid premature breakthrough while producing at a high rate. Moreover, the operator can shut down particular zones where there is a breakthrough while preserving the other zones' production.

After construction of one of the assemblies above described, and the washpipe has been removed, a production string is installed having preferably a plurality of the seal assemblies with at least one tool stop mechanism to locate the seal assemblies at points where the basepipe is smooth and the inner diameter is not reduced. Location may also be assured based upon the liner hanger. The seal assemblies allow different zones to be created and maintained so that selective conditions may be generated in discrete zones.

In an alternative embodiment of the dehydration ports, the closing sleeve 62 is not locked and remains operable so that if needed, individual closing sleeves may be opened. This alternative embodiment provides the invention with even more utility in that it allows the well operator to contaminate selected sections of the gravel pack to even more strongly hamper the ability of fluid to move longitudinally through the gravel pack. More specifically, the sleeve 62 would be opened by a shifting tool and an injection tool (one of many known to the art) would be used to apply a contamination fluid through the open port 60. The contamination fluid could be cement, drilling mud, epoxy, etc. and once injected into the gravel pack through the port it would fill all interstitial spaces in the pack making it even more impermeable.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A hydrocarbon production system in a substantially horizontal borehole comprising:

a gravel packing base pipe including at least one blank base pipe section and at least one holed base pipe section;

an openable and closeable port in said blank pipe section, said port extending from an outside diameter of said blank pipe section to an inside diameter of said blank pipe section, said port facilitating leak-off of gravel slurry fluid; and a gravel pack having a quantity of gravel packed around said holed base pipe section and said blank base pipe section.

2. A hydrocarbon production system in a substantially horizontal borehole as claimed in claim 1 wherein said port is a sliding sleeve controlled port.

3. A hydrocarbon production system in a substantially horizontal borehole as claimed in claim 2 wherein said sleeve is closed by withdrawal of a washpipe from said system.

4. A hydrocarbon production system in a substantially horizontal borehole as claimed in claim 3 wherein said sleeve is locked when closed.

5. A hydrocarbon production system in a substantially horizontal borehole as claimed in claim 1 wherein said port when closed is locked closed.

6. A hydrocarbon production system in a substantially horizontal borehole as claimed in claim 1 wherein a contaminant is injected into said gravel pack through said port in said blank pipe section.

7. A hydrocarbon production system in a substantially horizontal borehole as claimed in claim 6 wherein said contaminant is selected from cement, drilling mud and epoxy.

8. A hydrocarbon production system for building a gravel pack in a substantially horizontal borehole comprising:

a gravel packing base pipe including at least one holed base pipe section and at least one blank base pipe section; and a selectively closeable port in said blank base pipe section.

9. A method for building a zonally isolated gravel pack comprising:

installing a base pipe having one or more slotted base pipe sections and a screen associated with each slotted base pipe section separated by at least one blank base pipe section having at least one closeable port and a screen located immediately over said at least one closeable port;

installing a washpipe;

pumping gravel to an annulus between one of an open hole formation and a casing, and said base pipe;

pulling said washpipe; and closing said at least one closeable port in said blank base pipe section.

10. A method as claimed in claim 9 wherein said closing of said at least one closeable port is by actuating a closing sleeve to cover said at least one closeable port.

11. A method as claimed in claim 10 wherein said sleeve is actuated by a profile on said washpipe during pulling of said washpipe.

12. A method as claimed in claim 9 wherein said method further includes reopening said at least one closeable port and pumping a contaminant into said gravel pack through said at least one closeable port.

13. A method as claimed in claim 12 wherein said contaminant is selected from cement, drilling mud and epoxy.

14. A well zonal control and isolation system comprising:

a plurality of holed base pipe segments;

at least one blank base pipe segment separating at least two of said plurality of holed base pipe segments into zones;

at least one closeable port in said blank pipe base segment;

a screen located circumferentially around each said holed base pipe segments and a separate screen located around each said at least one closeable port in said blank base pipe segment.

* * * * *